US010569581B2

(12) United States Patent
Ohta et al.

(10) Patent No.: US 10,569,581 B2
(45) Date of Patent: Feb. 25, 2020

(54) PRINTING PATTERN CREATION DEVICE AND PRINTING SYSTEM INCLUDING THE SAME

(71) Applicant: Roland DG Corporation, Hamamatsu-shi, Shizuoka (JP)

(72) Inventors: Takeomi Ohta, Hamamatsu (JP); Kazutoshi Funakoshi, Hamamatsu (JP); Takeshi Tozuka, Hamamatsu (JP); Hiroki Horiuchi, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 16/022,798

(22) Filed: Jun. 29, 2018

(65) Prior Publication Data

US 2019/0001719 A1 Jan. 3, 2019

(30) Foreign Application Priority Data

Jun. 30, 2017 (JP) ..... 2017-128883

(51) Int. Cl.

| | |
|---|---|
| ***B41J 29/38*** | (2006.01) |
| ***B41J 2/01*** | (2006.01) |
| ***B41J 2/21*** | (2006.01) |
| ***B41J 3/28*** | (2006.01) |
| ***B41J 3/407*** | (2006.01) |

(52) U.S. Cl.

CPC ..... *B41J 29/38* (2013.01); *B41J 2/01* (2013.01); *B41J 2/2114* (2013.01); *B41J 2/2117* (2013.01); *B41J 3/28* (2013.01); *B41J 3/407* (2013.01); *B41J 2202/21* (2013.01)

(58) Field of Classification Search

CPC ..... B41J 11/009; B41J 11/002; B41J 29/38; B41J 2/01; B41J 2/2114; B41J 2/2117; B41J 3/28; B41J 3/407; B41J 2202/21; C09D 11/10; C09D 11/322; C09D 11/38; C09D 11/54; B41M 5/0023;

(Continued)

(56) References Cited

U.S. PATENT DOCUMENTS 7,530,684 B2 * 5/2009 Yamanobe ..... B41J 2/2114 347/100

2005/0179725 A1 8/2005 Matsushima (Continued)

FOREIGN PATENT DOCUMENTS

JP 08-58082 A 3/1996

JP 2001-001509 A 1/2001

(Continued)

*Primary Examiner* — Thinh H Nguyen

(74) *Attorney, Agent, or Firm* — Keating & Bennett, LLP

(57) ABSTRACT

A printing pattern creation device includes an input to which information regarding a type of ink to be used to perform printing on a printing target, and information regarding the surface on which the printing is to be performed, are to be provided; a storage having stored thereon a plurality of predefined printing modes each to be executed as one printing process; a main creator to select one or at least two printing modes among the plurality of printing modes based on the information supplied to the input, and to arrange the selected printing modes in the order of execution, to create a printing pattern; and an output to output the created printing pattern to a recording device.

14 Claims, 9 Drawing Sheets

(58) Field of Classification Search
CPC ..... B41M 5/0047; B41M 5/0064; B41M 5/0011; B41M 5/0017; B41M 7/0018; B41M 7/009
See application file for complete search history.

(56) References Cited

U.S. PATENT DOCUMENTS

| | | | | |
|---|---|---|---|---|
| 2005/0243121 | A1 | 11/2005 | Onishi | |
| 2007/0002345 | A1 | 1/2007 | Gondak et al. | |
| 2009/0213161 | A1 | 8/2009 | Murai | |
| 2011/0050772 | A1 | 3/2011 | Kamijo | |
| 2011/0242176 | A1 | 10/2011 | Iritani et al. | |
| 2012/0293574 | A1 | 11/2012 | Iu et al. | |
| 2018/0001669 | A1* | 1/2018 | Furukawa ..... | B41J 11/002 |
| 2018/0056671 | A1 | 3/2018 | Boniface | |

FOREIGN PATENT DOCUMENTS

| | | | |
|---|---|---|---|
| JP | 2009-230738 | A | 10/2009 |
| JP | 2013-216035 | A | 10/2013 |
| WO | 03/043825 | A1 | 5/2003 |
| WO | 2016/142510 | A1 | 9/2016 |

* cited by examiner

PRINTING PATTERN CREATION DEVICE AND PRINTING SYSTEM INCLUDING THE SAME

CROSS REFERENCE TO RELATED APPLICATIONS

This application claims the benefit of priority to Japanese Patent Application No. 2017-128883 filed on Jun. 30, 2017. The entire contents of this application are hereby incorporated herein by reference.

BACKGROUND OF THE INVENTION

1. Field of the Invention

The present invention relates to a printing pattern creation device and a printing system including the same.

2. Description of the Related Art

Conventionally, a recording device performing overlapping printing on a printing target by use of a plurality of types of ink for the purpose of improving the quality of a printed item and the quality of design of the printed item is known (e.g., Japanese Laid-Open Patent Publication No. 2009-230738). The above-described recording device includes, for example, ink heads ejecting a plurality of types of ink, a support member supporting a printing target, and a moving device moving the support member in a scanning direction with respect to the ink heads. The operation of the recording device is controlled by a printing pattern including one or at least two printing processes, each including a repetition of ejection of ink from each of the ink heads and movement of the support member in the scanning direction with respect to the ink heads, arranged in the order of execution. Such a printing pattern defines the order of ejection of the plurality of types of ink. In order to realize high quality printing, it is important to set an appropriate printing pattern.

Usually, different types of ink are used for different printing jobs. Therefore, in the above-described recording device, a user needs to set a printing pattern for each printing job. Conventionally, the above-described type of recording device is often used by a specialist user who has a wide range of knowledge and experience in printing. Such a user sets the printing pattern based on the experience and his/her own sense. However, recently, installation of such a recording device in, for example, a retail store or the like has been spreading rapidly. Under such a situation, a user not skilled in handling the recording device often sets a printing pattern. As a result, it occurs occasionally that an inappropriate printing pattern is set in the recording device and as a result, a printing item as expected is not provided.

SUMMARY OF THE INVENTION

Preferred embodiments of the present invention provide printing pattern creation devices that each create a printing pattern allowing printing to be performed stably with a high printing quality even when a user having little knowledge or experience in printing uses a recording device, and printing systems including the same.

A printing pattern creation device according to a preferred embodiment of the present invention creates a printing pattern for a recording device including ink heads ejecting a plurality of types of ink, a support member supporting a printing target including a front surface and a rear surface, and a conveyor that moves the support member in a scanning direction with respect to the ink heads. The printing pattern includes one or at least two printing processes, each including a repetition of ejection of the ink from each of the ink heads and movement of the support member in the scanning direction with respect to the ink heads, arranged in the order of execution. The printing pattern creation device includes an input to which information regarding a type of ink to be used to perform printing on the printing target among the plurality of types of ink, and information regarding the surface on which the printing is to be performed, are to be input; a storage having stored thereon a plurality of predefined printing modes each to be executed as one printing process; a main creator that selects one or at least two printing modes among the plurality of printing modes based on the information input to the input, and arranges the selected printing modes in the order of execution, to create a printing pattern; and an output that outputs the created printing pattern to the recording device.

Making use of a printing pattern created by the above-described printing pattern creation device allows a setting that provides a high printing quality to be made in a simple manner even when a user having little knowledge or experience in printing uses a recording device. As a result, a high quality printing item is stably provided, and variation in the printing quality is decreased.

A printing system according to a preferred embodiment of the present invention includes the above-described printing pattern creation device; and a recording device communicably connected with the printing pattern creation device. The printing system performs stable printing with a high printing quality.

A non-transitory computer-readable storage medium storing a computer program according to a preferred embodiment of the present invention is structured to cause a computer to operate as the above-described printing pattern creation device.

Preferred embodiments of the present invention create a printing pattern that stably provides a high quality printed item.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to the drawings. The preferred embodiments described below are not intended to specifically limit the present invention. Components and portions that have the same functions will bear the same reference signs, and overlapping descriptions will be omitted or simplified optionally.

Figure 1:
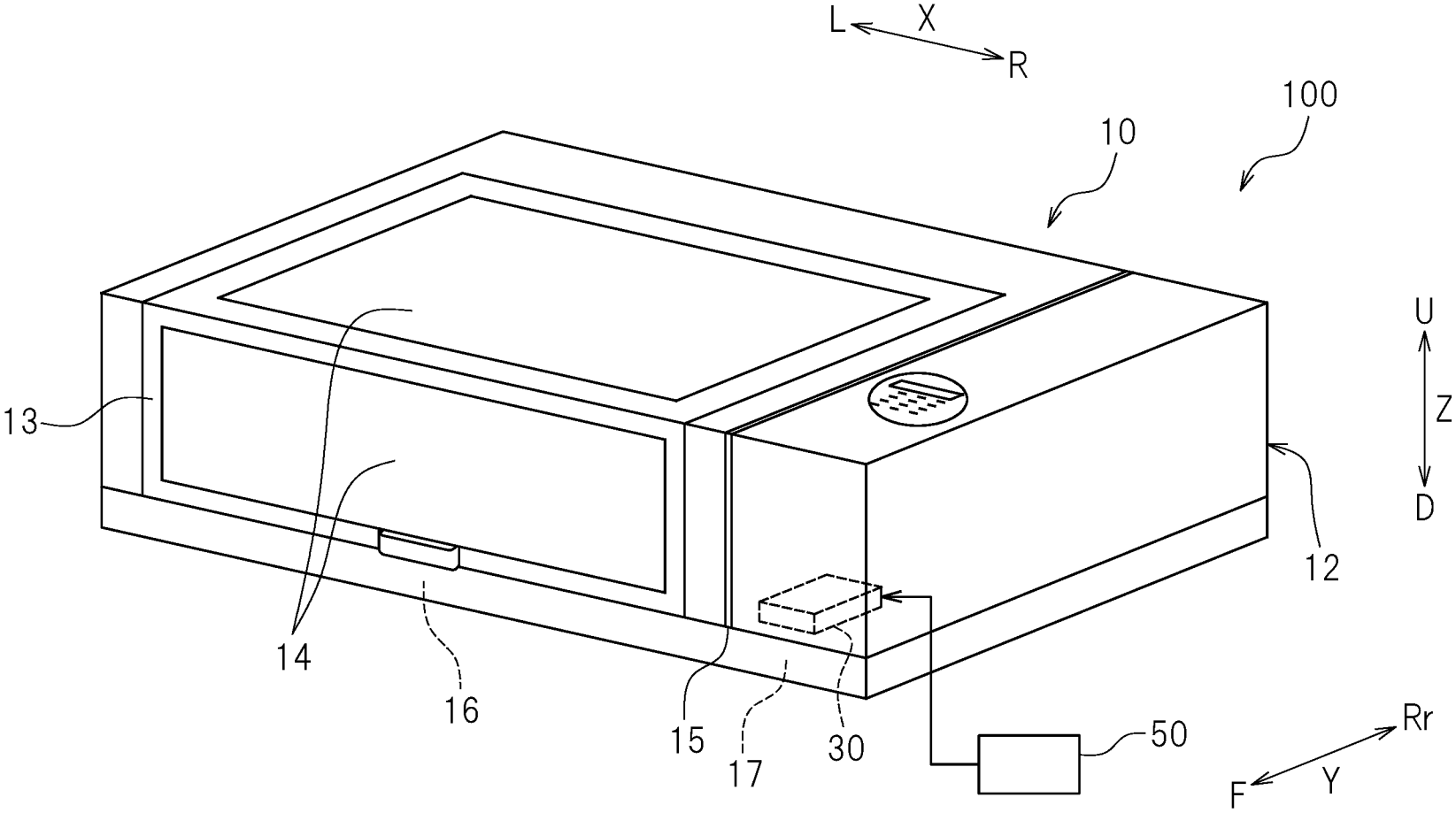
FIG. 1 is a perspective view of a printing system according to a preferred embodiment of the present invention.

FIG. 1 is a perspective view of a printing system 100. The printing system includes a recording device 10 and a printing pattern creation device 50. The recording device 10 and the printing pattern creation device 50 are communicably connected with each other in a wired or wireless manner. The printing pattern creation device 50 creates a printing pattern usable in the recording device 10. The printing system 100 is structured to perform printing on one or at least two printing targets 70 (see FIG. 11), by use of the recording device 10, by a printing pattern transmitted from the printing pattern creation device 50.

In the following description, "left", "right", "up" and "down" are left, right, up and down as seen from a user facing a front surface of the recording device 10. A direction approaching the user from the recording device 10 is referred to as a "forward direction", and a direction distanced away from the user toward the recording device 10 is referred to as a "rearward direction". In the figures, letters F, Rr, L, R, U and D respectively refer to "front", "rear", "left", "right", "up" and "down". Letters X, Y and Z respectively refer to a "left-right direction", a "front-rear direction", and an "up-down direction". These directions are merely defined for the sake of convenience, and do not limit the manner of installation of the recording device 10.

Figure 2:
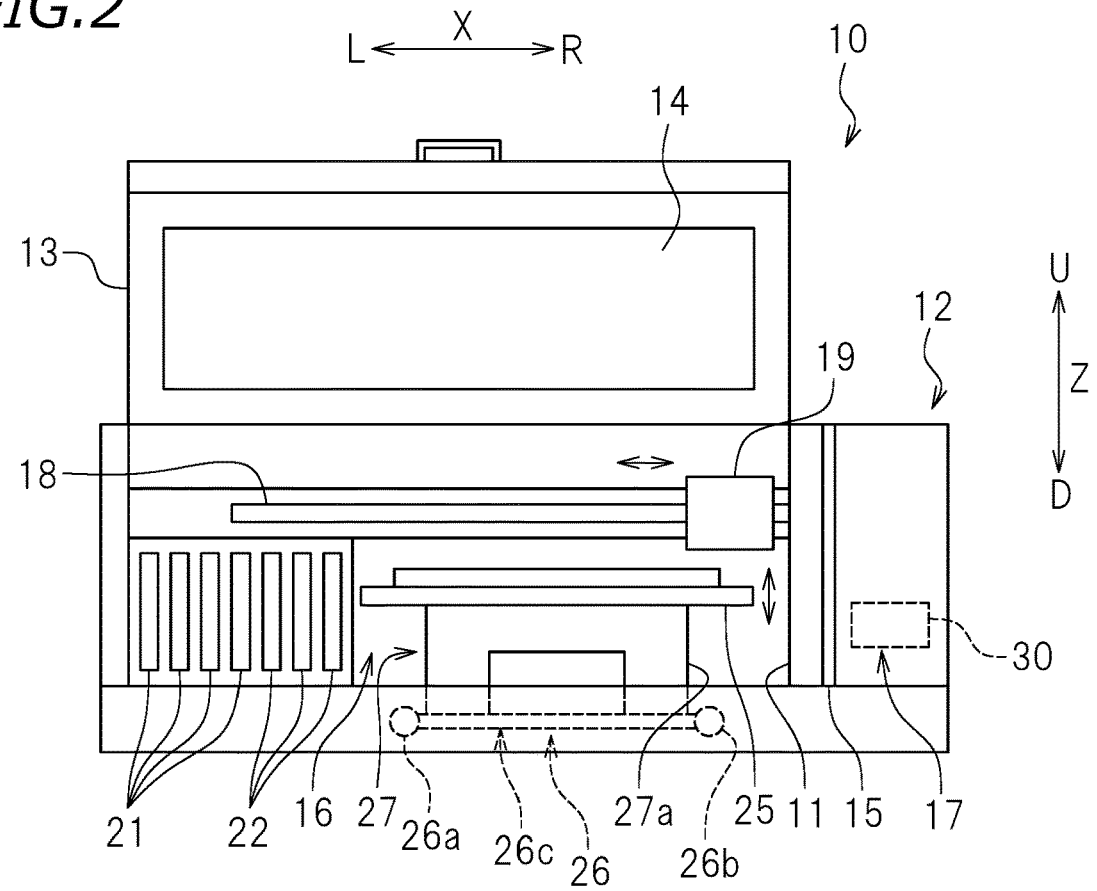
FIG. 2 is a front view of a recording device according to a preferred embodiment of the present invention.
Figure 3:
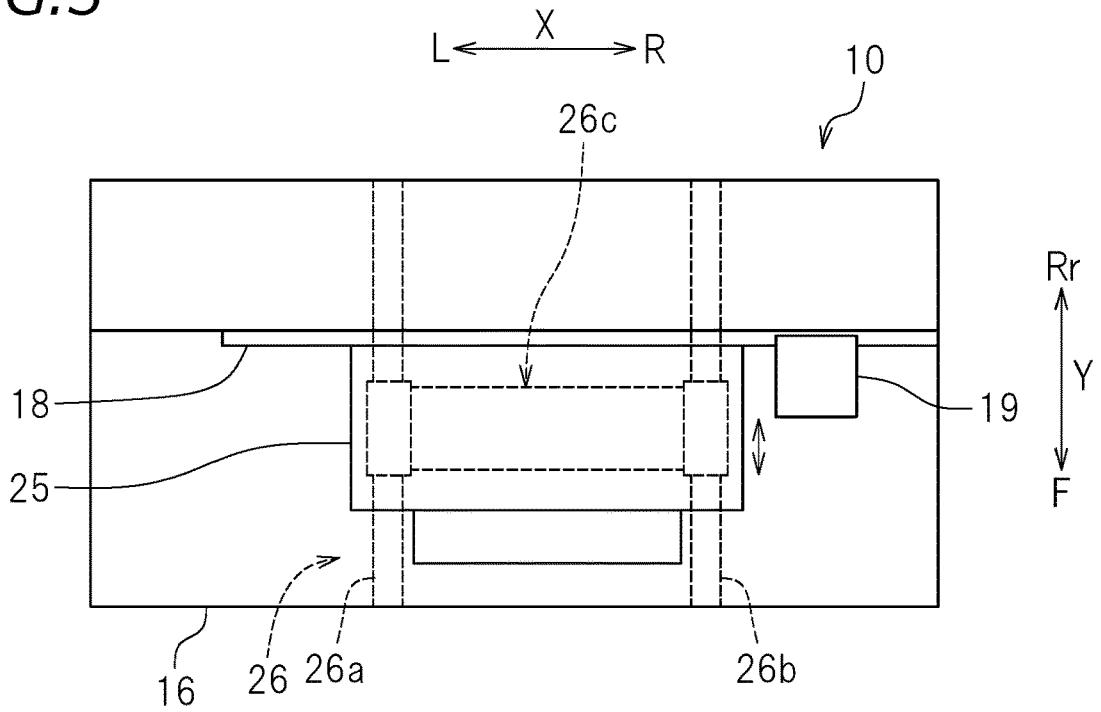
FIG. 3 is a plan view of a printing area according to a preferred embodiment of the present invention.

FIG. 2 is a front view of the recording device 10. FIG. 3 is a plan view of a printing area 16 of the recording device 10. The recording device 10 is an eject printer (hereinafter, referred to simply as a "printer") performing the printing on the printing target 70. In this specification, the term "inkjet printer" refers to a printer in general that uses a printing method realized by a conventionally known inkjet technology, for example, a continuous system such as a binary deflection system a continuous deflection system or the like; a thermal system; or any of various on-demand systems such as a piezoelectric element system or the like.

The printing target 70 includes a front surface and a rear surface. The printing target 70 may be, for example, a planar sheet such as a transfer sheet or the like. Alternatively, the printing target 70 may be any of various cases such as a mobile phone case or the like; a compact electronic device such as an electronic cigarette or the like; a small item such as a key chain, a photo frame or the like; a daily-use item; a case for cosmetics; a three-dimensional item such as a fashion accessory or the like. The printing target 70 may be formed of paper such as plain paper, inkjet printing paper or the like; a resin such as polyvinylchloride, acrylic resin, polycarbonate, polystyrene, acrylonitrile-butadiene-styrene (ABS) copolymer or the like; a metal material such as aluminum, stainless steel or the like; carbon; pottery; ceramics; glass; rubber; leather; etc.

The printer 10 is box-shaped, for example. The printer 10 includes a casing 12 provided with an opening 11, and a front cover 13 capable of opening or closing the opening 11. The front cover 13 is supported by the casing 12 so as to be rotatable about a rear end as a rotation axis. The front cover 13 is rotated upward about the rear end thereof as an axis and thus is opened, so that an inner space and an outer space of the casing 12 are communicated with each other. The front cover 13 is provided with a window 14. The window 14 is made of a transparent material. A user may check the inner space of the casing 12 through the window 14 even in the state where the front cover 13 is closed.

The inner space of the casing 12 is divided by a partitioning member 15 into the printing area 16 and a control area 17. The printing area 16 is a space to the left of the partitioning member 15. The control area 17 is a space to the right of the partitioning member 15. The control area 17 accommodates a controller 30.

A guide rail 18 is located above the printing area 16. The guide rail 18 is secured to the casing 12, and extends in the left-right direction X. A carriage 19 is slidably provided on the guide rail 18. The carriage 19 is reciprocally movable in the left-right direction X along the guide rail 18 by a carriage mover (not shown). The carriage mover (not shown) includes a pair of pulleys (not shown) respectively located at a right end and a left end of the guide rail 18, and an endless belt (not shown) and a carriage motor (not shown). The carriage 19 is secured to the endless belt extended between, and wound along, the pair of pulleys. One of the pulleys is coupled with the carriage motor. The carriage motor is electrically connected with the controller 30, and is controlled by the controller 30. When the carriage motor is driven, the pulleys are rotated and thus the belt runs. As a result, the carriage 19 is moved in the left-right direction X along the guide rail 18.

Figure 4:
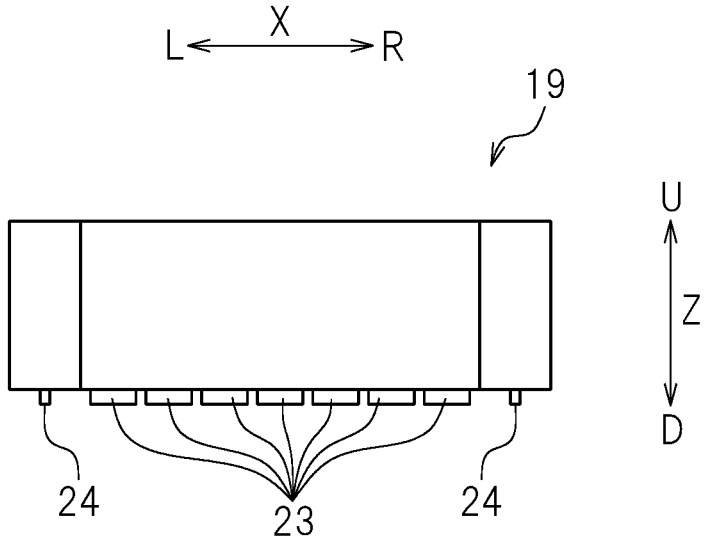
FIG. 4 is a partial enlarged view of a carriage according to a preferred embodiment of the present invention.

FIG. 4 is a partial enlarged view of the carriage 19. The carriage 19 includes seven ink heads 23 and two ultraviolet lamps 24, for example. The ink heads 23 are provided to eject a plurality of types of ink toward the printing target 70. The ink heads 23 are arrayed side by side in the left-right direction X and provided in an in-line array. The ink heads 23 are respectively communicated with ink cartridge 21 and 22 via flexible ink tubes (not shown).

The ink cartridges 21 and 22 store ultraviolet-curable ink. The ultraviolet-curable ink typically contains a polymerizable compound and a polymerization initiator. The ink cartridges 21 respectively store process color ink (CMYK) of cyan ink (C), magenta ink (M), yellow ink (Y) and black ink (K). The process color ink is usable to form an image. The ink cartridges 22 respectively store special ink of primer ink (Pr), white ink (Wh) and coating ink (coat). The ink stored in the ink cartridges 22 is different in color, use and the like from the process color ink stored in the ink cartridges 21. In this specification, the term "special ink" refers to any ink that has a different color and/or properties from those of the process color ink. In this specification, the expression "plurality of types of ink" refers to any two or more types of ink selected from a plurality of colors of process color ink (CMYK) and a plurality of types of special ink (Pr, Wh, coat, etc.). Specifically, the expression "plurality of types of ink" refers to a plurality of process color ink (CMYK) different in color and at least one type of special ink.

The primer ink (Pr) is pre-processing ink used when, for example, the printing target 70 on which the printing is to be performed is highly ink-repelling, in order to allow ink to be well fixed to the printing target 70. The primer ink is used to form an underlying layer before the process color ink or the special ink other than the primer ink is printed on the printing target 70. The primer ink is typically transparent. The white ink (Wh) is used to form an image and also is used when, for example, the printing target 70 is transparent or block, in order to form an underlying layer to allow the process color ink to better express a color thereof. The coating ink (coat) is used for surface processing. The coating ink is used to finish the surface after, for example, the process color ink or the white ink is used to form an image. The coating ink is typically transparent. The coating ink may provide a lustrous glossy surface finish (Gcoat) or a lack-luster matte surface finish (Mcoat) in accordance with, for example, the number of times of ejection of the ink or the timing at which the ultraviolet lamps 24 direct light.

In this preferred embodiment, the printer 10 includes four ink cartridges 21 and three ink cartridges 22, for example. The number of the ink cartridges is not limited to the above. The ink cartridges 21 and 22 may be each provided in the number of one, two, three, four, or five or more. For example, the ink cartridges 22 do not need to include the ink cartridges storing the white ink and/or the primer ink and/or the coating ink.

The ultraviolet lamps 24 are provided to direct ultraviolet light toward the printing target 70 in order to cure the ink. One ultraviolet lamp 24 is located at a left end of the ink heads 23, and the other ultraviolet lamp 24 is located at a right end of the ink heads 23. The ultraviolet lamps 24 are arrayed side by side with the ink heads 23 in the left-right direction X. The ultraviolet lamps 24 direct light having an ultraviolet wavelength capable of curing the ink. The ultraviolet lamps 24 may be, for example, LEDs, fluorescent lamps (low pressure mercury lamps) or high pressure mercury lamps. In this example, two ultraviolet lamps 24 are provided. Alternatively, one ultraviolet lamp 24 or three or more ultraviolet lamps 24 may be provided. The ultraviolet lamps 24 may be mounted on a carriage different from the carriage including the ink heads 23. The ultraviolet lamps 24 may be provided on, for example, a wall of the casing 12.

The printer 10 is a so-called flatbed printer. Below the carriage 19, a table 25 is provided. The table 25 supports the printing target 70. The table 25 is an example of support member. The table 25 is movable in the front-rear direction Y by a first table mover 26. The table 25 is movable in the up-down direction Z by a second table mover 27. The first table mover 26 is an example of moving device that moves the table 25 in the scanning direction with respect to the ink heads 23.

The first table mover 26 includes slide rails 26*a* and 26*b*, a transporter 26*c*, and a front-rear moving motor (not shown). The slide rails 26*a* and 26*b* extend in the front-rear direction Y. The slide rails 26*a* and 26*b* are parallel or substantially parallel to each other. The transporter 26*c* is slidable with respect to the slide rails 26*a* and 26*b*. The table 25 is supported above the transporter 26*c* via another member. The front-rear moving motor is electrically connected with the controller 30, and is controlled by the controller 30. When the front-rear moving motor is driven, the transporter 26*c* moves along the slide rails 26*a* and 26*b*. As a result, the table 25 moves in the front-rear direction Y. In this preferred embodiment, one of two directions defined as the front-rear direction Y, namely, a direction from an upstream position to a downstream position in the direction in which the table 25 is transported, is a scanning direction.

The second table mover 27 includes a height adjusting member 27*a* and an up-down moving motor (not shown). The height adjusting member 27*a* is provided on a bottom surface of the table 25. The height adjusting member 27*a* is connected to the up-down moving motor. The up-down moving motor is electrically connected with the controller 30, and is controlled by the controller 30. When the up-down moving motor is driven, the height of the height adjusting member 27*a* is changed to adjust the level of the table 25.

The controller 30 provided in the control area 17 is configured or programmed to control an operation of each of components of the printer 10. The controller 30 is typically a computer. The controller 30 includes, for example, an interface (I/F) to receive a printing pattern from the printing pattern creation device 50, a central processing unit (CPU) to execute a command of a control program, a ROM (read only memory) including a program or programs executable by the CPU stored thereon, a RAM (random access memory) usable as a working area in which the program is developed, and a storage device such as a memory or the like that has the above-mentioned program or programs and various types of data stored thereon.

The controller 30 is communicably connected with the carriage motor of the carriage mover, the front-rear moving motor of the first table mover 26, and the up-down moving motor of the second table mover 27, and controls the positional relationship between the printing target 70 and the ink heads 23. The controller 30 is communicably connected with the ink heads 23, and controls the ejection of the ink toward the printing target 70. The controller 30 is communicably connected with the ultraviolet lamps 24, and controls the ultraviolet lamps 24 to be started and stopped. When one printing process is finished, the controller 30 determines whether or not the printing pattern includes the next printing process. The controller 30 is configured or programmed to, in the case where the printing pattern includes the next printing process, drive the front-rear moving motor of the first table mover 26 to return the table 25 in one of the two directions defined as the front-rear direction Y up to the position where the immediately previous printing process was started.

The printing pattern creation device 50 is provided to create a printing pattern used by the printer 10. In this specification, the term "printing pattern" includes one or at least two printing processes, each including a repetition of ejection of the ink from each of the ink heads 23 and movement of the table 25 in the scanning direction with respect to the ink heads 23, arranged in the order of execution. In this preferred embodiment, the "printing pattern" includes one or at least two printing process, each including a repetition of reciprocal movement of the carriage 19 along the guide rail 18, ejection of the ink from each of the ink heads 23 and movement of the table 25 in the scanning direction with respect to the ink heads 23, arranged in the order of execution. The printing pattern creation device 50 is typically a computer, and includes, for example, a CPU, a ROM and a RAM. In this example, the printing pattern creation device 50 is an external device connected with the printer 10. Alternatively, the printing pattern creation device 50 may be built in the controller 30 of the printer 10.

The printing pattern creation device 50 may be a computer program or programs to cause a CPU of a computer to operate as the printing pattern creation device 50. Such a computer program may be stored on a non-transitory computer-readable storage medium to perform an operation or operations of the printing pattern creation device 50. Examples of the storage medium include a semiconductor storage medium (e.g., ROM, non-volatile memory card), an optical storage medium (e.g., DVD, MO, MD, CD, BD), a magnetic storage medium (e.g., magnetic tape, flexible disc) and the like. The computer program or programs may be transmitted to a server computer via the above-described storage medium or a network such as the Internet or the like. In this case, the server computer is a preferred embodiment of the present invention disclosed herein.

Figure 5:
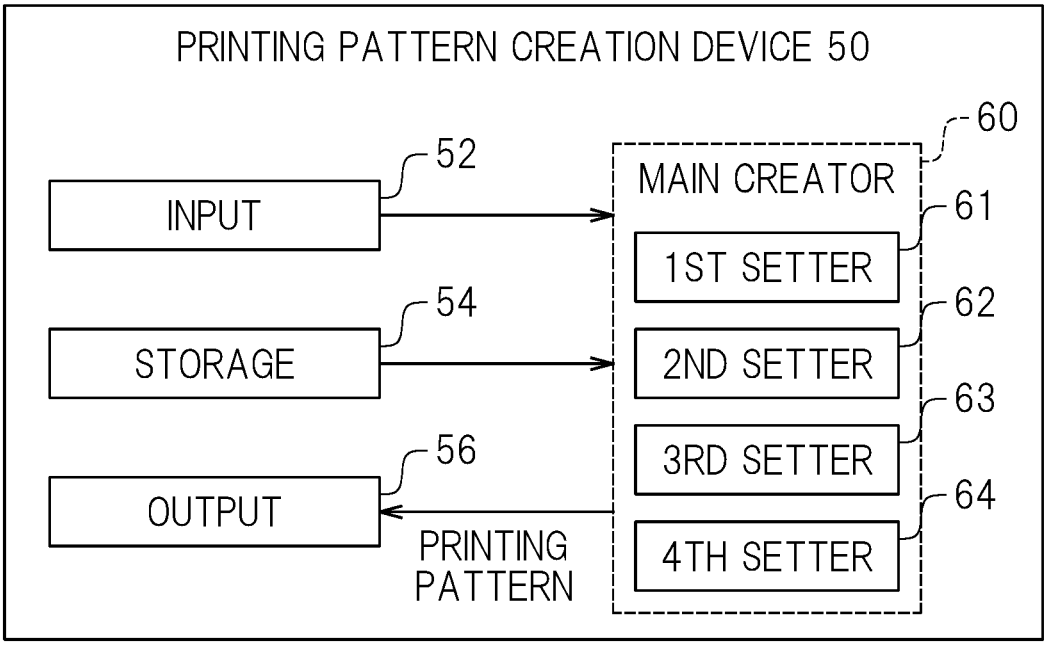
FIG. 5 is a block diagram showing a structure of a printing pattern creation device according to a preferred embodiment of the present invention.

FIG. 5 is a block diagram showing a structure of the printing pattern creation device 50. The printing pattern creation device 50 includes an input 52, a storage 54, an output 56, and a main creator 60. Each of such components of the printing pattern creation device 50 are mutually communicable. Each of the components of the printing pattern creation device 50 may be realized by software or hardware. Each of the components of the printing pattern creation device 50 may be provided by one or a plurality of processors or may be incorporated into a circuit.

Information necessary to create a printing pattern is provided to the input 52 by the user. The input 52 is typically structured to allow information necessary to create a printing pattern to be input thereto from an external device such as a host computer or the like or from a network connected with the input 52 in a wired of wireless manner. Alternatively, the input 52 may include, for example a keyboard, a mouse, a button or the like, so that the user may input information manually to create a printing pattern. The information input to the input 52 is read into the main creator 60.

The storage 54 includes a plurality of printing modes each executable as one printing process stored thereon in advance, from the point of view of realizing a high printing quality. The printer 10 in this preferred embodiment includes the ink heads 23 located in the in-line array in the carriage 19 and the ultraviolet lamps 24 located to the left and to the right of the ink heads 23. Therefore, the printer 10 may eject two types of ink at the maximum during one printing process. The printer 10 may eject only one type of ink in one printing process, or may eject a first type of ink from a first ink head 23 and after that (e.g., several milliseconds later), eject a second type of ink from a second ink head 23 continuously.

The storage 54 in this preferred embodiment has the following nine printing modes (modes 1 through 9) stored thereon, for example. The printing modes stored on the storage 54 are read into the main creator 60. The following abbreviations correspond to the types of ink stored in the ink cartridges 21 and 22. In the case where two types of ink are coupled together with a hyphen (-), it is indicated that two types of ink are ejected in the shown order in one printing process.

Mode 1: Wh-CMYK
Mode 2: CMYK-Wh
Mode 3: CMYK-Mcoat
Mode 4: Wh-Mcoat
Mode 5: Wh
Mode 6: CMYK
Mode 7: Pr
Mode 8: Gcoat
Mode 9: Mcoat Mode 1 is a printing process in which the white ink (Wh) is ejected and then the process color ink (CMYK) is ejected. Mode 2 is a printing process in which the process color ink (CMYK) is ejected and then the white ink (Wh) is ejected. Mode 3 is a printing process in which the process color ink (CMYK) is ejected and then the coating ink is ejected to provide a matte surface finish (Mcoat). Mode 4 is a printing process in which the white ink (Wh) is ejected and then the coating ink is ejected to provide a matte surface finish (Mcoat). Mode 5 is a printing process in which only the white ink (Wh) is ejected. Mode 6 is a printing process in which only the process color ink (CMYK) is ejected. Mode 7 is a printing process in which only the primer ink (Pr) is ejected. Mode 8 is a printing process in which only the coating ink is ejected to provide a glossy surface finish (Gcoat). Mode 9 is a printing process in which only the coating ink is ejected to provide a matte surface finish (Mcoat).

Based on the information input to the input 52, the main creator 60 selects one or at least two printing modes from the printing modes stored on the storage 54, and arranges the selected printing modes in the order of execution. As a result, a printing pattern is created. The main creator 60 includes a first setter 61, a second setter 62, a third setter 63 and a fourth setter 64. The printing pattern created by the main creator 60 is transmitted to the printer 10 via the output 56. Hereinafter, a procedure of creating a printing pattern will be described.

Figure 6:
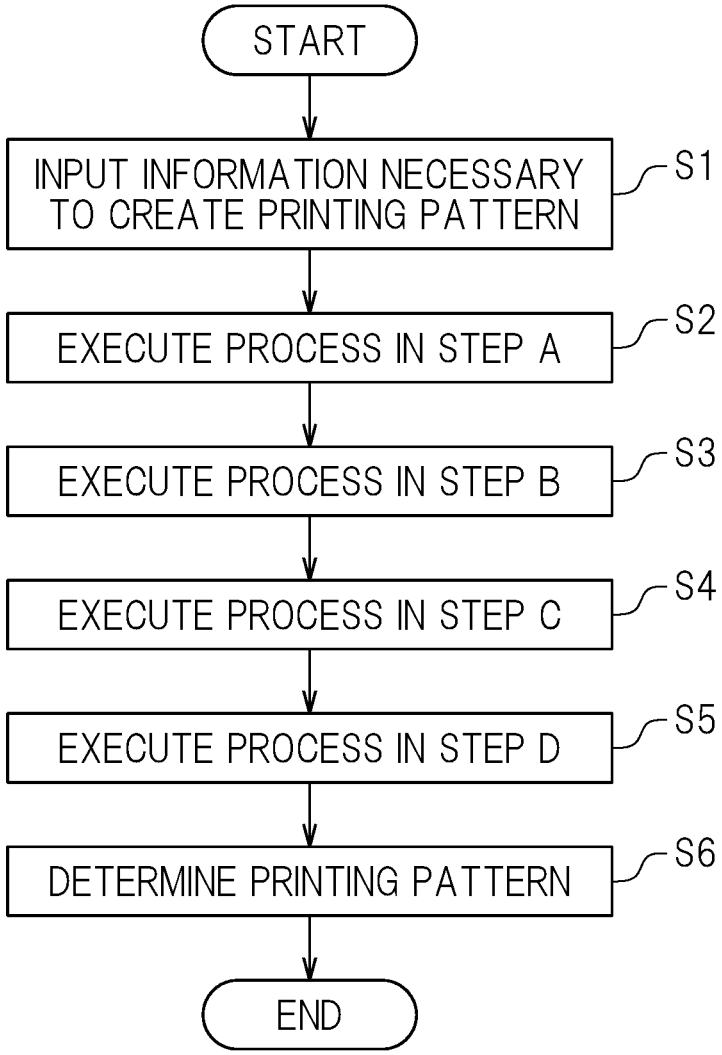
FIG. 6 shows an example of flowchart showing a procedure of determining a printing pattern.

FIG. 6 shows an example of flowchart showing a procedure of determining a printing pattern by the main creator 60. In this example, a case where there is one printing target 70 and a printing pattern is created to perform one printing job on one printing target 70 will be described. In this preferred embodiment, first, in step S1, the user inputs information necessary to create a printing pattern into the input 52. The information necessary to create a printing pattern includes, for example, (1) information regarding the type of ink, among the plurality of types of ink mounted on the printer 10, that is to be used to perform the printing on one printing target 70; (2) information regarding the surface of the printing target 70 on which the printing is to be performed; (3) information regarding whether or not a glossy surface finish is to be provided; and (4) information regarding whether or not a matte surface finish is to be provided. In this preferred embodiment, the input is restricted such that the two types of surface finishes mentioned in (3) and (4) are not used concurrently. In other words, it is restricted such that when the information in one of (3) and (4) is "to be provided", the information in the other of (3) and (4) is always "not to be provided". It should be noted that the two types of surface finishes mentioned in (3) and (4) may be used concurrently.

Figure 7:
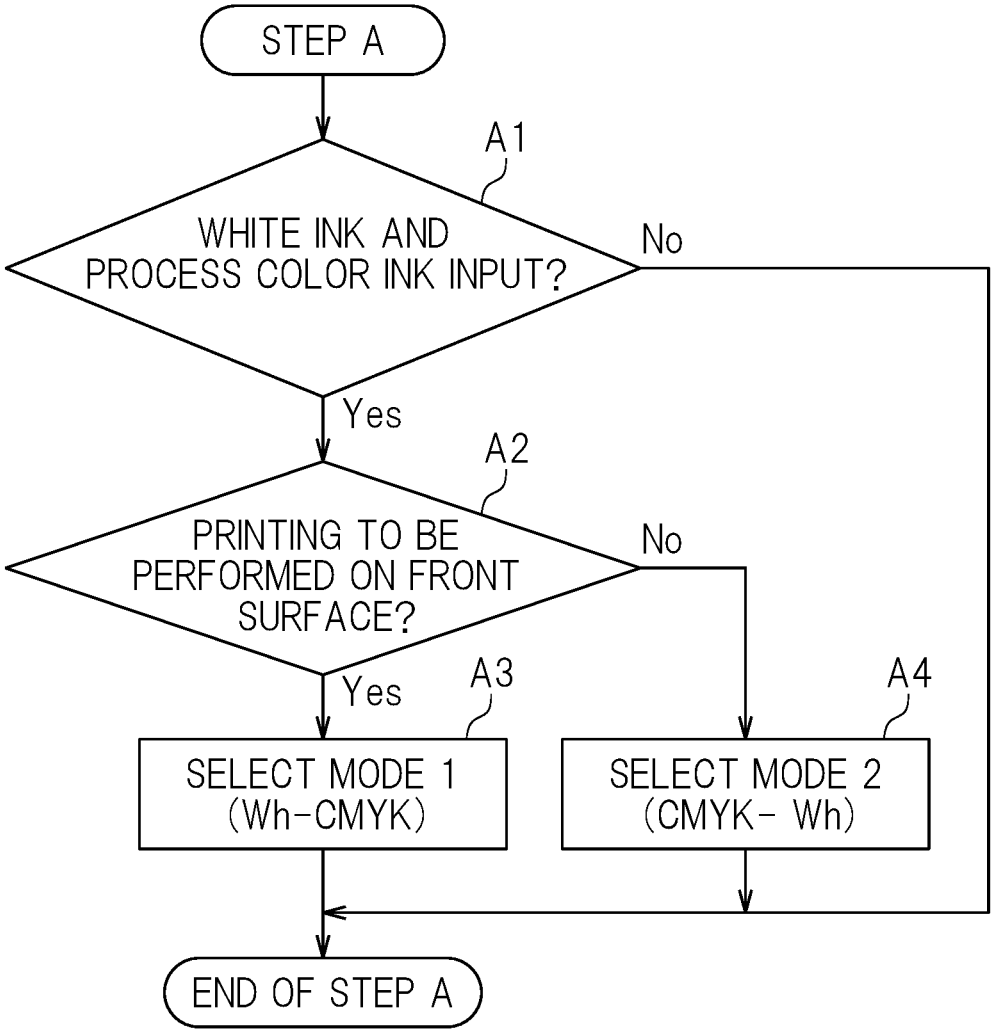
FIG. 7 shows an example of flowchart showing a process in step A shown in FIG. 6.

Next, in step S2, the first setter 61 of the main creator 60 executes a process of step A. FIG. 7 is a flowchart showing a form of step A. In this preferred embodiment, first, in step A1, it is determined whether or not the white ink and the process color ink have been input to the input 52 as (1) the type of ink to be used. In other words, it is determined whether or not the white ink and the process color ink are to be used to perform the printing on the printing target 70. In the case where the white ink and/or the process color ink has not been input (No in step A1), step A is finished. By contrast, in the case where the white ink and the process color ink have been input (Yes in step A1), the process advances to step A2.

In step A2, it is determined whether or not the "front surface" has been input as (2) the surface on which the printing is to be performed. In the case where the front surface has been input (Yes in step A2), the process advances to step A3. In step A3, mode 1 (Wh-CMYK) is selected from the nine printing modes stored on the storage 54. Mode 1 (Wh-CMYK) is a mode in which the white ink and the process color ink are ejected in this order in one printing process. Then, step A is finished. By contrast, in the case where the "front surface" has not been input as (2) the surface on which the printing is to be performed (No in step A2), the process advances to step A4. In step A4, mode 2 (CMYK-Wh) is selected from the nine printing modes stored on the storage 54. Mode 2 (CMYK-Wh) is a mode in which the process color ink and the white ink are ejected in this order in one printing process. Then, step A is finished. In the case where the "front surface" has not been input as the surface on which the printing is to be performed, the "rear surface" has always been input.

Figure 8:
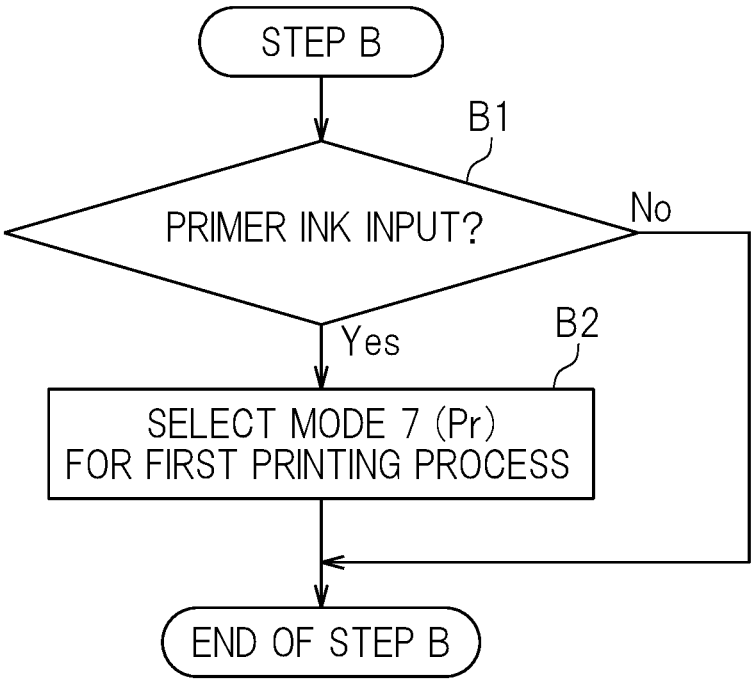
FIG. 8 shows an example of flowchart showing a process in step B shown in FIG. 6.

Next, in step S3, the second setter 62 of the main creator 60 executes a process of step B. FIG. 8 is a flowchart showing a form of step B. In this preferred embodiment, first, in step B1, it is determined whether or not the primer ink has been input to the input 52 as (1) the type of ink to be used. In the case where the primer ink has not been input (No in step B1), step B is finished. By contrast, in the case where the primer ink has been input (Yes in step B1), the process advances to step B2. In step B2, mode 7 (Pr) is selected from the nine printing modes stored on the storage 54. Mode 7 (Pr) is a mode in which only the primer ink is ejected in one printing process. The second setter 62 determines that the printing process of ejecting the primer ink is to be executed first among all the printing processes. Then, step B is finished.

Figure 9:
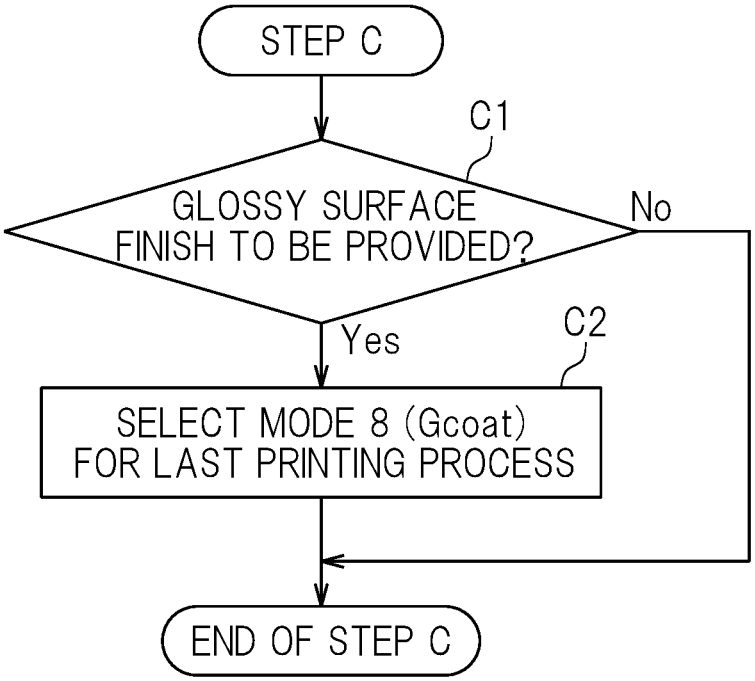
FIG. 9 shows an example of flowchart showing a process in step C shown in FIG. 6.

Next, in step S4, the third setter 63 of the main creator 60 executes a process of step C. FIG. 9 is a flowchart showing a form of step C. In this preferred embodiment, first, in step C1, regarding (3) information regarding whether or not a glossy surface finish is to be provided, it is determined whether or not "to be provided" has been input to the input 52. In the case where a glossy surface finish is not to be provided (No in step C1), step C is finished. By contrast, in the case where a glossy surface finish is to be provided (Yes in step C1), the process advances to step C2. In step C2, mode 8 (Gcoat) is selected from the nine printing modes stored on the storage 54. Mode 8 (Gcoat) is a mode in which only the coating ink is ejected in one printing process to provide a glossy surface finish. The third setter 63 determines that the printing process of ejecting the coating ink is to be executed last among all the printing processes. Then, step C is finished.

Figure 10:
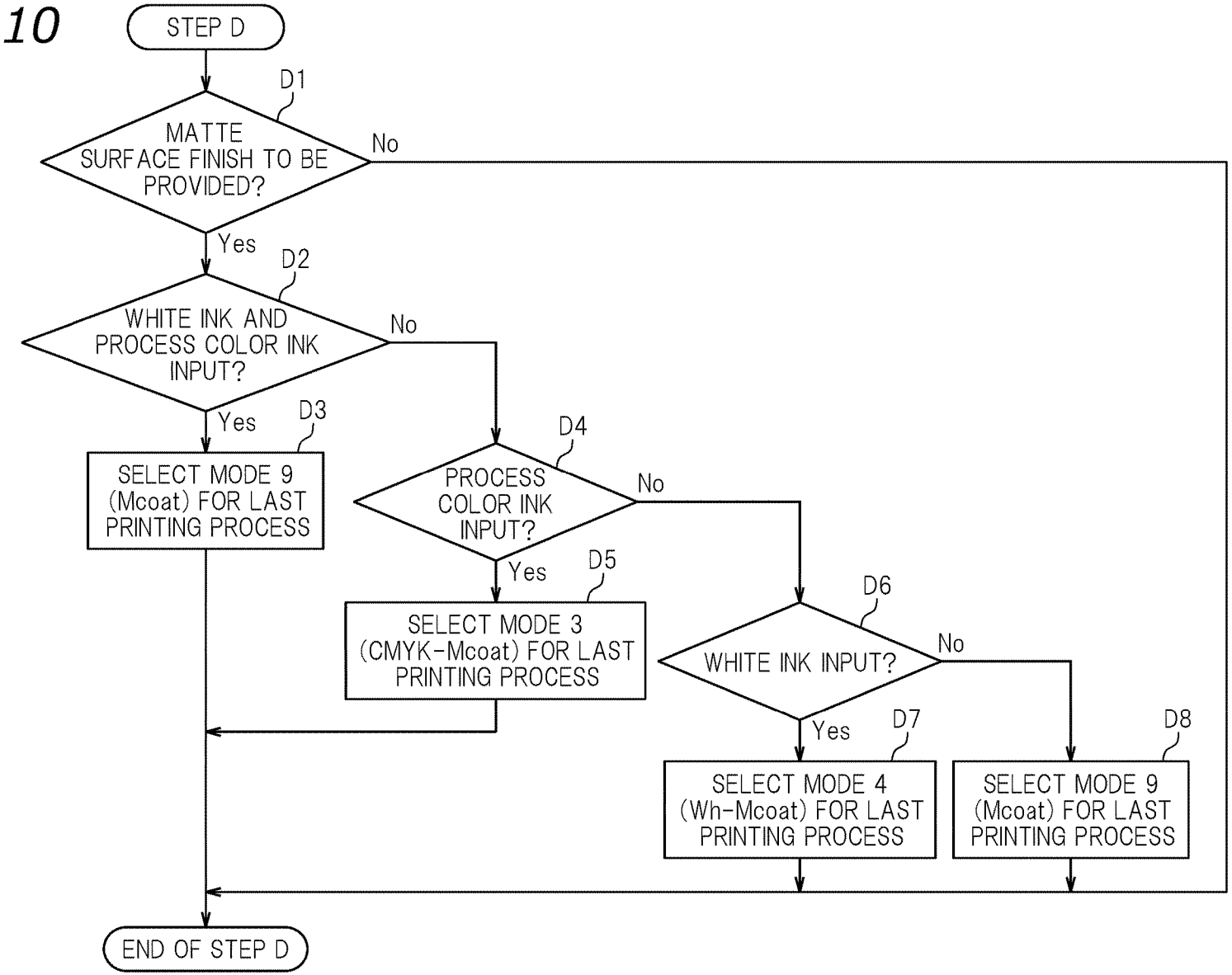
FIG. 10 shows an example of flowchart showing a process in step D shown in FIG. 6.

Next, in step S5, the fourth setter 64 of the main creator 60 executes a process of step D. FIG. 10 is a flowchart showing a form of step D. In this preferred embodiment, first, in step D1, regarding (4) information regarding whether or not a matte surface finish is to be provided, it is determined whether or not "to be provided" has been input to the input 52. In the case where a matte surface finish is not to be provided (No in step D1), step D is finished. By contrast, in the case where a matte surface finish is to be provided (Yes in step D1), the process advances to step D2.

In step D2, it is determined whether or not the white ink and the process color ink have been input to the input 52 as (1) the type of ink to be used. In the case where the white ink and the process color ink have been input (Yes in step D2), the process advances to step D3. In step D3, mode 9 (Mcoat) is selected from the nine printing modes stored on the storage 54. Mode 9 (Mcoat) is a mode in which only the coating ink is ejected in one printing process to provide a matte surface finish. The fourth setter 64 determines that the printing process of ejecting the coating ink is to be executed last among all the printing processes. Then, step D is finished. By contrast, in the case where the white ink and/or the process color ink has not been input (No in step D2), the process advances to step D4.

In step D4, it is determined whether or not the process color ink has been input to the input 52 as (1) the type of ink to be used. In the case where the process color ink has been input (Yes in step D4), the process advances to step D5. In step D5, mode 3 (CMYK-Mcoat) is selected from the nine printing modes stored on the storage 54. Mode 3 (CMYK-Mcoat) is a mode in which the process color ink and the coating ink are ejected in this order in one printing process. The fourth setter 64 determines that the printing process of ejecting the coating ink is to be executed last among all the printing processes. Then, step D is finished. By contrast, in the case where the process color ink has not been input (No in step D4), the process advances to step D6.

In step D6, it is determined whether or not the white ink has been input to the input 52 as (1) the type of ink to be used. In the case where the white ink has been input (Yes in step D6), the process advances to step D7. In step D7, mode 4 (Wh-Mcoat) is selected from the nine printing modes stored on the storage 54. Mode 4 (Wh-Mcoat) is a mode in which the white ink and the coating ink are ejected in this order in one printing process. The fourth setter 64 determines that the printing process of ejecting the coating ink is to be executed last among all the printing processes. Then, step D is finished. By contrast, in the case where the white ink has not been input (No in step D6), the process advances to step D8.

In step D8, mode 9 (Mcoat) is selected from the nine printing modes stored on the storage 54. Mode 9 (Mcoat) is a mode in which only the coating ink is ejected in one printing process to provide a matt surface finish. The fourth setter 64 determines that the printing process of ejecting the coating ink is to be executed last among all the printing processes. Then, step D is finished.

Next, in step S6, the main creator 60 creates a printing pattern based on steps S1 through S5 described above. Specifically, first, (1) the information regarding the types of ink to be used, which are input to the input 52 in step S1, and the types of ink to be used in the printing modes selected in steps S2 through S5, are compared against each other. In the case where (1) the type(s) of ink to be used includes any type of ink that is not to be used in the printing mode selected in steps S2 through S5, a printing mode(s) of ejecting only such a type of ink is selected. Next, the selected printing modes are arranged in the order of execution to create a printing pattern.

As described above, according to the procedure in this preferred embodiment, the printing modes each to be executed as one printing process and the order of execution of one or at least two such printing processes are automatically determined. Thus, a printing pattern that is optimal from the point of view of the printing quality is created. With such a printing pattern, the printer 10 performs one or at least two printing processes and provides high quality printing on the printing target 70. Hereinafter, some practical examples will be described.

Example 1

In example 1, it is assumed that the following information is input as information (1) through (4) to the input 52 in step S1.

(1) Types of ink to be used: Pr, Wh, CMYK, coat (2) Surface on which the printing is to be performed: front surface (3) Glossy surface finish: not to be provided (4) Matte surface finish: to be provided In step S2, the first setter 61 executes the process in step A1. In this example, the white ink and the process color ink have been input, and therefore, the process advances to step A2. Next, the first setter 61 executes the process in step A2. In this example, the surface on which the printing is to be performed is the front surface. Therefore, in step A3, mode 1 (Wh-CMYK) is selected, and step A is finished. At this point, it has not been determined when and in what order the printing process of mode 1 is to be performed.

Next, in step S3, the second setter 62 executes the process in step B1. In this example, the primer ink has been input. Therefore, in step B2, mode 7 (Pr) is selected. It is determined that the printing process of ejecting the primer ink is performed first among all the printing processes. Then, step B is finished.

Next, in step S4, the third setter 63 executes the process in step C1. In this example, a glossy surface finish is not to be provided. Therefore, step C is finished.

Next, in step S5, the fourth setter 64 executes the process in step D1. In this example, a matte surface finish is to be provided. Therefore, the process advances to step D2. Next, the fourth setter 64 executes the process in step D2. In this example, the white ink and the process color ink have been input, and it has already been determined to perform a printing mode of using the pair of the white ink and the process color ink. Therefore, in step D3, mode 9 (Mcoat) is selected. It is determined that the printing process of ejecting the coating ink is performed last among all the printing processes. Then, step D is finished.

In step S6, the main creator 60 creates a printing pattern based on S1 through S5 described above. Specifically, first, the main creator 60 compares the information regarding the types of ink input to the input 52 in step S1, and the types of ink to be used in the printing modes selected in steps S2 through S5, against each other. The types of ink match each other. Therefore, the main creator 60 arranges the printing modes selected in steps S2 through S5 in the order of execution to create a printing pattern. In this example, as described below, a printing pattern including the printing process of mode 7 (Pr) to be executed first, the printing process of mode 1 (Wh-CMYK) to be executed next, and the printing process of mode 9 (Mcoat) to be executed at the end is created. According to this printing pattern, three printing processes in total are performed by the printer 10. High quality printing is performed efficiently on the printing target 70.

| Printing process | Printing mode |
|---|---|
| $1^{st}$ Mode | 7 |
| $2^{nd}$ Mode | 1 |
| $3^{rd}$ Mode | 9/END |

Example 2

In example 2, it is assumed that the following information is input as information (1) through (4) to the input 52 in step S1.

(1) Types of ink to be used: CMYK, coat (2) Surface on which the printing is to be performed: front surface (3) Glossy surface finish: to be provided (4) Matte surface finish: not to be provided In step S2, the first setter 61 executes the process in step A1. In this example, the white ink has not been input, and therefore, step A is finished. Next, in step S3, the second setter 62 executes the process in step B1. In this example, the primer ink has not been input. Therefore, step B is finished. Next, in step S4, the third setter 63 executes the process in step C1. In this example, a glossy surface finish is to be provided. Therefore, in step C2, mode 8 (Gcoat) is selected. It is determined that the printing process of ejecting the coating ink is performed last among all the printing processes. Then, step C is finished. In this preferred embodiment, it is restricted that two types of surface finishes are not both provided. Therefore, in the case where the last printing process to be performed is determined in step S4, step S5 may be omitted.

In step S6, the main creator 60 creates a printing pattern based on S1 through S5 described above. Specifically, first, the main creator 60 compares the information regarding the types of ink input to the input 52 in step S1, and the types of ink to be used in the printing modes selected in steps S2 through S5, against each other. The types of ink to be used in the printing modes selected in steps S2 through S5 do not include the process color ink. Therefore, mode 6 (CMYK) of ejecting only the process color ink is selected. Then, the main creator 60 arranges the selected printing modes in the order of execution to create a printing pattern. In this example, as described below, a printing pattern including the printing process of mode 6 (CMYK) to be executed first and the printing process of mode 8 (Gcoat) to be executed at the end is created. According to this printing pattern, two printing processes in total are performed by the printer 10. High quality printing is performed efficiently on the printing target 70.

| Printing process | Printing mode |
|---|---|
| $1^{st}$ Mode | 6 |
| $2^{nd}$ Mode | 8/END |

Example 3

In example 3, it is assumed that the following information is input as information (1) through (4) to the input 52 in step S1.

(1) Types of ink to be used: CMYK, coat (2) Surface on which the printing is to be performed: rear surface (3) Glossy surface finish: not to be provided (4) Matte surface finish: to be provided In this example, the processes of step S2 and step S3 are executed in the same manner as in example 2. Then, in step S4, the third setter 63 executes the process in step C1. In this example, a glossy surface finish is not to be provided. Therefore, step C is finished. Next, in step S5, the fourth setter 64 executes the process in step D1. In this example, a matte surface finish is to be provided. Therefore, the process in step D2 is executed. In this example, the white ink has not been input. Therefore, the process in step D4 is executed. In this example, the process color ink has been input. Therefore, in step D5, mode 3 (CMYK-Mcoat) is selected. It is determined that the printing process of ejecting the coating ink is performed last among all the printing processes. Then, step D is finished.

In step S6, the main creator 60 creates a printing pattern based on S1 through S5 described above. Specifically, first, the main creator 60 compares the information regarding the types of ink input to the input 52 in step S1, and the types of ink to be used in the printing modes selected in steps S2 through S5, against each other. The types of ink match each other. Therefore, the main creator 60 arranges the printing modes selected in steps S2 through S5 in the order of execution to create a printing pattern. In this example, as described below, a printing pattern including the printing process of mode 3 (CMYK-Mcoat) only is created. According to this printing pattern, one printing process in total is performed by the printer 10. High quality printing is performed efficiently on the printing target 70.

| Printing process | Printing mode |
|---|---|
| 1st Mode | 3/END |

In the above-described preferred embodiment, a case where one printing job is executed on one printing target 70 is specifically described as an example. The present invention is not limited to such a case. The technology disclosed herein is preferably applicable to a case where a plurality of printing jobs are executed on first and second printing targets 70 at the same time.

Figure 11:
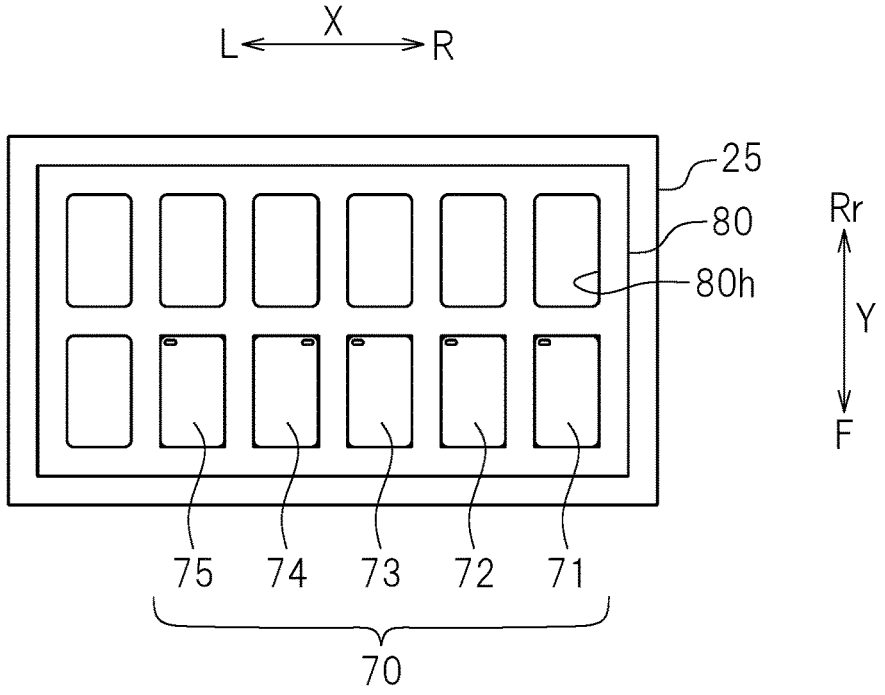
FIG. 11 is a plan view of a palette located on a table and accommodating a plurality of printing targets.

FIG. 11 is a plan view showing a palette 80 placed on the table 25. The palette 80 has a plurality of printing targets located thereon. The palette 80 is a tool specifying the position of each of the printing targets 70. In the case where a plurality of printing targets 70 are subjected to printing at the same time, the palette 80 may accommodate the plurality of printing targets 70 to prevent the positions thereof from being shifted from each other. The palette 80 is a plate-shaped member. There is no specific limitation on the external shape of the palette 80. In this example, the palette 80 has the same shape as that of the table 25, and is rectangular as seen in a plan view.

The palette 80 is provided with a plurality of location holes 80*h* corresponding to the external shape of the printing targets 70. In this example, the plurality of location holes 80*h* are of the same shape and the same size (processing error is permissible). The plurality of location holes 80*h* are arrayed side by side in the left-right direction X and the front-rear direction Y. There is no specific limitation on the number of the location holes 80*h*. In this example, six location holes 80*h* are arrayed in the left-right direction X and two location holes 80*h* are arrayed in the front-rear direction Y in the palette 80. Twelve location holes 80*h* are formed in total. There is no specific limitation on the shape of the location holes 80*h*. In this example, the location holes 80*h* are rectangular as seen in a plan view. Alternatively, the location holes 80*h* may be, for example, triangular, square, circular, star-shaped or the like. In this example, the location holes 80*h* are through-holes running through the palette 80 in a height direction Z. Alternatively, the location holes 80*h* may be, for example, recessed portions formed by shaving a top portion of the palette 80, may be defined by frames protruding from the palette 80, or may be a line, pattern or the like drawn on a surface of the palette 80.

On the palette 80, five printing targets 71 through 75 of the same type and the same size are located as the plurality of printing targets 70. The printing targets 71, 72, 73 and 75 are to have the printing performed on front surfaces thereof, and are accommodated in the location holes 80*h* with the front surfaces being directed upward. The printing target 74 is to have the printing performed on a rear surface thereof, and is accommodated in the location hole 80*h* with the rear surface being directed upward. Different printing jobs are to be performed on the five printing targets 71 through 75. In this example, the size and the shape of the printing targets 70 located in the location holes 80*h* are the same as those of the location holes 80*h*. Alternatively, the size of the printing targets 70 located in the location holes 80*h* may be smaller than that of the location holes 80*h*. The shape of the printing targets 70 located in the location holes 80*h* may be different from that of the location holes 80*h*.

Figure 12:
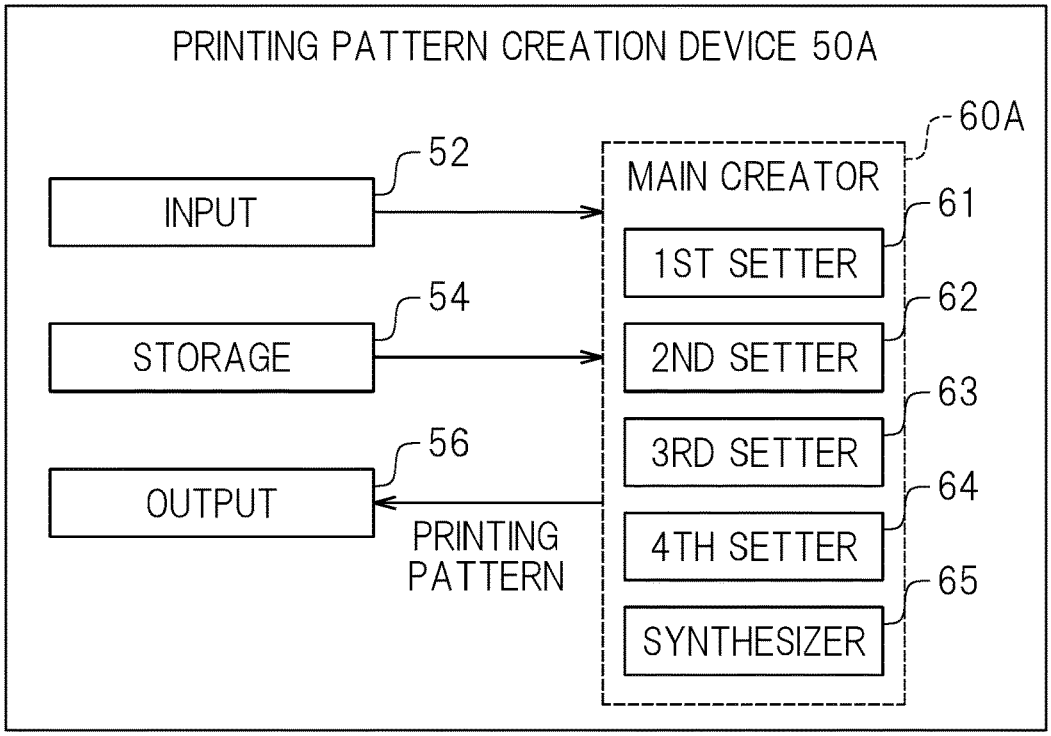
FIG. 12 is a block diagram showing a structure of a printing pattern creation device according to another preferred embodiment of the present invention.

FIG. 12 is a block diagram showing a structure of a printing pattern creation device 50A. The printing pattern creation device 50A includes the input 52, the storage 54, the output 56, and a main creator 60A. The main creator 60A includes a synthesizer 65 in addition to the first setter 61, the second setter 62, the third setter 63 and the fourth setter 64 described above. The synthesizer 65 is structured to synthesize information included in printing jobs to create one synthesized printing job. With the printing pattern creation device 50A, a setting that allows a plurality of different printing jobs to be performed on the plurality of printing targets 70 at the same time in one printing process is made in a simple manner.

Figure 13:
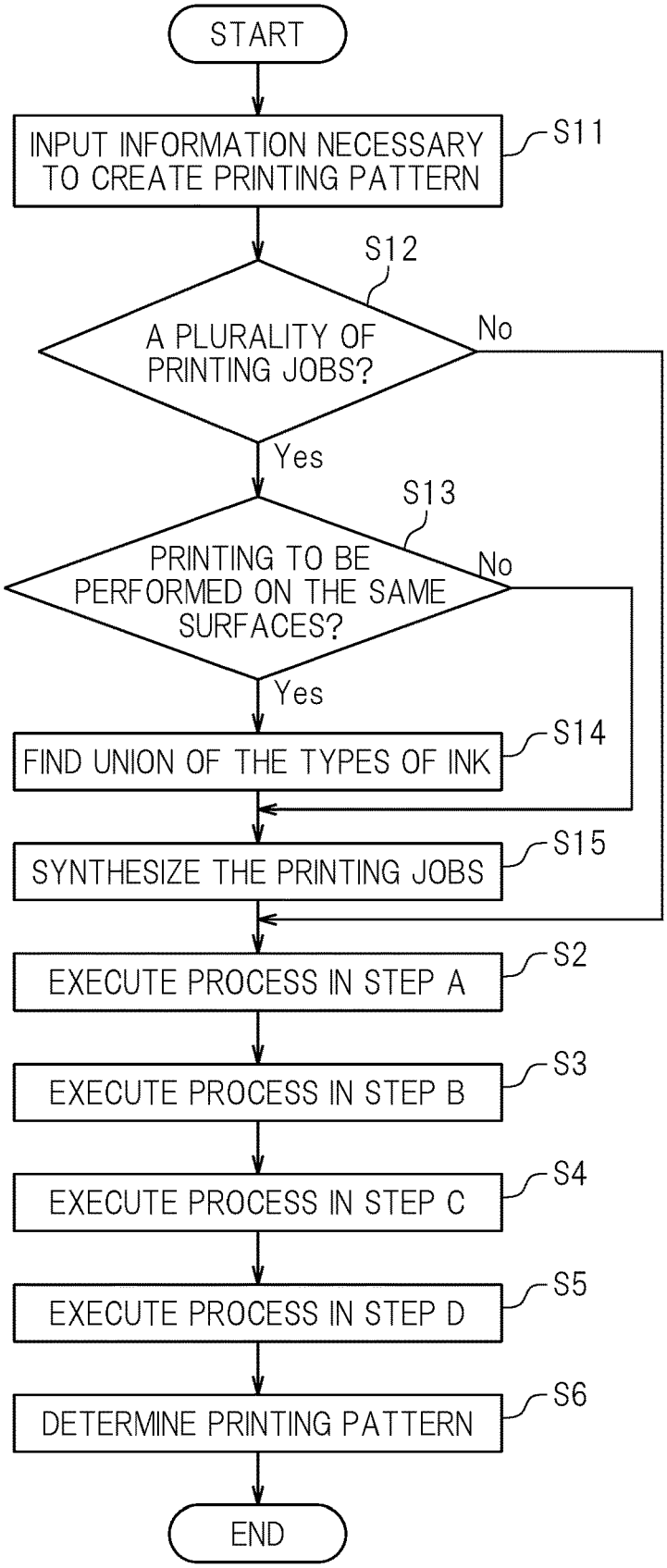
FIG. 13 shows another example of flowchart showing a procedure of determining a printing pattern.

FIG. 13 is a flowchart showing a procedure of determining a printing pattern by the main creator 60A. In this preferred embodiment, first, in step S11, the user inputs the above-described information (1) through (4) necessary to create a printing pattern into the input 52. In step S11, information (1) through (4) is input for each of the plurality of printing jobs. The plurality of printing jobs have the same resolution with each other. The information input to the input 52 is read into the main creator 60A.

Next, in step S12, the synthesizer 65 determines whether or not a plurality of printing jobs have been input, in other words, whether or not a plurality of sets of information (1) through (4) have been input. In the case where a plurality of printing jobs have not been input (No in step S12), the procedure advances to step S2, and steps A through D are executed like in the preferred embodiment shown in FIG. 6. By contrast, in the case where a plurality of printing jobs have been input (Yes in step S12), the procedures advances to step S13.

Next, in step S13, the synthesizer 65 determines whether or not the printing is to be performed on the same surfaces of all the printing targets 70. In the case where the printing is not to be performed on the same surfaces of all the printing targets 70 (No in step S13), the procedure advances to step S15. By contrast, in the case where the printing is to be performed on the same surfaces of all the printing targets 70 (Yes in step S13), the procedure advances to step S14.

Next, in step S14, the synthesizer 65 synthesizes the types of ink to be used in the printing jobs that are performed on the same surfaces. Specifically, the synthesizer 65 determines a union of the types of ink. Next, in step S15, the synthesizer 65 creates one virtual synthesized printing job based on steps S11 through S14. Next, in steps S2 through S5, the main creator 60A executes steps A through D described above, like in the preferred embodiment shown in FIG. 6. In step S6, the main creator 60A creates a printing pattern optimal from the point of view of the printing quality. With such a printing pattern, the printer 10 performs one or at least two printing processes, and performs different printing jobs on the plurality of printing targets 70 at the same time in one printing process. In this example, the printing targets 70 subjected to the printing at the same time are of the same type and the same size. Alternatively, the printing targets 70 may be of different types and/or different sizes. Hereinafter, specific examples will be described.

Example 4

In example 4, it is assumed that five printing jobs (printing jobs 1 through 5) having the following information (1) through (4) are input to the input 52 in step S11.

Printing Job 1

(1) Types of ink to be used: CMYK (2) Surface on which the printing is to be performed: front surface (3) Glossy surface finish: not to be provided (4) Matte surface finish: not to be provided Printing Job 2

(1) Types of ink to be used: Wh, CMYK, coat (2) Surface on which the printing is to be performed: front surface (3) Glossy surface finish: not to be provided (4) Matte surface finish: to be provided Printing Job 3

(1) Types of ink to be used: CMYK, coat (2) Surface on which the printing is to be performed: front surface (3) Glossy surface finish: not to be provided (4) Matte surface finish: to be provided Printing Job 4

(1) Types of ink to be used: CMYK, Wh (2) Surface on which the printing is to be performed: rear surface (3) Glossy surface finish: not to be provided (4) Matte surface finish: not to be provided Printing Job 5

(1) Types of ink to be used: Pr, CMYK, coat (2) Surface on which the printing is to be performed: front surface (3) Glossy surface finish: not to be provided (4) Matte surface finish: to be provided In this example, in step S12, the synthesizer 65 determines whether or not a plurality of printing jobs have been input. In this example, printing jobs 1 through 5 have been input. Therefore, the synthesizer 65 executes the process in step S13. In this example, printing jobs 1, 2, 3 and 5 are to be performed on the front surfaces, namely, on the same surfaces. Therefore, the synthesizer 65 executes the process in step S14, more specifically, determines a union of the types of ink to be used in printing jobs 1, 2, 3 and 5. The union of CMYK in printing job 1, Wh, CMYK, coat in printing job 2, CMYK, coat in printing job 3, Pr, CMYK, coat in printing job 5 is "Pr, Wh, CMYK, coat".

Next, in step S15, the synthesizer 65 creates one virtual synthesized printing job. The synthesized printing job is as follows.

| (1) Types of ink to be used | (2) Surface printed |
|---|---|
| Pr, Wh, CMYK, coat | front surface |
| Wh, CMYK | rear surface |

Next, the main creator 60A executes the processes in steps A through D described above. In this example, the white ink and the process color ink have been input for each of the front surface and the rear surface. Therefore, mode 1 (Wh-CMYK) and mode 2 (CMYK-Wh) are selected. In this example, the primer ink has been input for the front surface. Therefore, mode 7 (Pr) is selected. It is determined that the printing process of ejecting the primer ink is performed first among all the printing processes. In this example, the coating ink has been input for the front surface, and it has already been determined to perform a printing mode of using the pair of the white ink and the process color ink. Therefore, mode 9 (Mcoat) is selected. It is determined that the printing process of ejecting the coating ink is performed last among all the printing processes.

In step 6, the main creator 60A compares the information regarding the types of ink input to the input 52 in step S11, and the types of ink to be used in the printing modes selected in steps S2 through S5, against each other. The types of ink match each other. Therefore, the main creator 60A arranges the printing modes selected in steps S2 through S5 in the order of execution to create a printing pattern that is optimal from the point of view of printing quality. In this example, as described below, a printing pattern including the printing process of mode 7 (Pr) to be executed first, the printing process of mode 1 (Wh-CMYK) to be executed next, the printing process of mode 2 (CMYK-Wh) to be executed next, and the printing process of mode 9 (Mcoat) to be executed at the end is created. There is no specific limitation on which of mode 1 and mode 2 is to be executed first. In this example, the printing mode of a smaller value is executed first. According to this printing pattern, four printing processes in total are performed by the printer 10. Different printing jobs are performed on the plurality of printing targets 70 at the same time in one printing process.

| Printing process | Printing mode |
|---|---|
| $1^{st}$ Mode | 7 |
| $2^{nd}$ Mode | 1 |
| $3^{rd}$ Mode | 2 |
| $4^{th}$ Mode | 9/END |

As described above, the printing pattern creation devices 50 and 50A in the preferred embodiments according to the present invention automatically create an appropriate printing pattern in consideration of the printing quality. Even a user who does not have much knowledge or experience and does not know much about the types of ink, printing modes, order of execution of printing processes or the like may use the printing pattern created by the printing pattern creation device 50 or 50A to make a printing setting that provides a high quality printing result, with no trials and errors. Making use of a printing pattern created by the printing pattern creation device 50 or 50A allows the number of times of printing to be reduced or minimized, and allows the time and work required for the printing to be reduced or minimized. Therefore, the printing is performed at a high efficiency.

In the case where different printing jobs are to be performed on the plurality of printing targets 71 through 75, different types of ink may be needed for the printing jobs. In this case, conventionally, a complicated printing pattern needs to be set manually for the printer 10 while the type of ink to be used for each printing job is checked. This requires a long time and a large amount of work. By contrast, the printing pattern creation device 50A, even when a plurality of different printing jobs are input, automatically creates an appropriate printing pattern. Therefore, the user does not need to make a complicated setting for the printer 10, and the printing is performed efficiently. In this manner, the printing pattern creation device 50A further alleviates the load on the user.

The printing pattern creation devices 50 and 50A are preferably usable in a form in which a user not accustomed to use the printer 10 makes a printing setting. A standalone KIOSK printer that is installed in a retailer such as, for example, a mobile phone store, a store of an electric and electronics home appliances chain, a photo developer, a store in a shopping mall or the like is assumed to be operated by a store clerk who is not specialized in printing in response to an order from a customer, or to be operated by a customer. The printing pattern creation devices 50 and 50A may be preferably used in combination with such a KIOSK printer. Especially, the printing pattern creation device 50A is preferably usable in a form in which the user, upon receipt of orders from customers, performs different printing jobs at the same time in one printing process. The printing system 100 including the printing pattern creation device 50A is preferably usable to provide additional values to products; for example, it is usable to perform printing on a mobile phone case in a mobile phone store or to perform printing on an electronic cigarette in a store of an electric and electronics home appliances chain.

In the preferred embodiments according to present invention, the ink ejected from the ink heads 23 includes the process color ink and the white ink. The storage 54 has stored thereon in advance at least a first printing mode as a printing process of ejecting the white ink and then ejecting the process color ink from the ink heads 23, and a second printing mode as a printing process of ejecting the process color ink and then ejecting the white ink from the ink heads 23. The main creator 60 includes the first setter 61 structured as follows. In the case where the process color ink and the white ink are input to the input 52 as the types of ink to be used, and the front surface is input to the input 52 as the surface on which the printing is to be performed, the first setter 61 selects the first printing mode among the plurality of printing modes stored on the storage 54. In the case where the process color ink and the white ink are input to the input 52 as the types of ink to be used, and the rear surface is input to the input 52 as the surface on which the printing is to be performed, the first setter 61 selects the second printing mode among the plurality of printing modes stored on the storage 54.

With such a structure, in the case where the white ink and the process color ink are both used, a printing pattern of ejecting these types of ink in one processing process is created. As a result, as compared with a case where, for example, the white ink and the process color ink are ejected in different printing processes, the color of the process color ink is better expressed to realize a desired visual effect in a preferred manner. In addition, the underlying layer formed of the white ink is prevented from being positionally shifted from the image formed of the process color ink. Therefore, a printing setting that stably provides a high quality printed item is made for the printer 10.

In the preferred embodiments according to the present invention, the ink ejected from the ink heads 23 includes the primer ink. The storage 54 has stored thereon in advance at least a third printing mode as a printing process of ejecting only the primer ink from the ink head 23. The main creator 60 further includes the second setter 62 structured as follows. In the case where the primer ink is input to the input 52 as the type of ink to be used, the second setter 62 selects the third printing mode among the plurality of printing modes stored on the storage 54, and sets the third printing mode as the printing process to be performed first. With such a structure, a printing setting that provides a high quality printed item is automatically made for the printer 10 having the primer ink mounted thereon.

In the preferred embodiments according to the present invention, the ink ejected from the ink heads 23 includes the coating ink. To the input 52, information regarding whether or not a glossy surface finish is to be provided is input. The storage 54 has stored thereon in advance at least a fourth printing mode as a printing process of ejecting only the coating ink from the ink head 23 to provide a glossy surface finish. The main creator 60 further includes the third setter 63 structured as follows. In the case where the coating ink is input to the input 52 as the type of ink to be used, and information that a glossy surface finish is to be provided is input to the input 52, the third setter 63 selects at least the fourth printing mode among the plurality of printing modes stored on the storage 54, and sets the fourth printing mode as the printing process to be performed at the end. With such a structure, a printing setting that stably provides a printed item with a glossy surface finish is automatically made for the printer 10 having the coating ink mounted thereon.

In the preferred embodiments according to present invention, the ink ejected from the ink heads 23 includes the process color ink, the white ink and the coating ink. To the input 52, information regarding whether or not a matte surface finish is to be provided is input. The storage 54 has stored thereon in advance at least a fifth printing mode as a printing process of ejecting only the coating ink from the ink head 23 to provide a matte surface finish, a sixth printing mode as a printing process of ejecting the white ink and then ejecting the coating ink from the ink heads 23 to provide a matte surface finish, and a seventh printing mode as a printing process of ejecting the process color ink and then ejecting the coating ink from the ink heads 23 to provide a matte surface finish. The main creator 60 includes the fourth setter 64 structured as follows. In the case where the process color ink, the white ink and the coating ink are input to the input 52 as the types of ink to be used, and information that a matte surface finish is to be provided is input to the input 52, the fourth setter 64 selects at least the fifth printing mode among the plurality of printing modes stored on the storage 54, and sets the fifth printing mode as the printing process to be performed at the end. In the case where the process color ink and the coating ink are input to the input 52 as the types of ink to be used, and information that a matte surface finish is to be provided is input to the input 52, the fourth setter 64 selects at least the sixth printing mode among the plurality of printing modes stored on the storage 54, and sets the sixth printing mode as the printing process to be performed at the end. In the case where the white ink and the coating ink are input to the input 52 as the types of ink to be used, and information that a matte surface finish is to be provided is input to the input 52, the fourth setter 64 selects at least the seventh printing mode among the plurality of printing modes stored on the storage 54, and sets the seventh printing mode as the printing process to be performed at the end. With such a structure, a printing setting that stably provides a printed item with a matte surface finish is automatically made for the printer 10 having the coating ink mounted thereon.

In the preferred embodiments according to present invention, the printing pattern creation device also creates a printing pattern of performing a first printing job on a first printing target and a second printing job different from the first printing job on a second printing target at the same time in one printing process. To the input 52, information regarding the types of ink to be used to perform the first printing job, information regarding the surface on which the first printing job is to be performed, information regarding the types of ink to be used to perform the second printing job, and information regarding the surface on which the second printing job is to be performed, are to be input. The main creator 60A further includes the synthesizer 65 structured as follows. In the case where the surface on which the first printing job is to be performed is the same as the surface on which the second printing job is to be performed, the synthesizer 65 determines a union of the types of ink to be used for the first printing job and the types of ink to be used for the second printing job, and thus creates a synthesized printing job including the first printing job and the second printing job in a synthesized manner. With such a structure, a plurality of printing jobs are performed at the same time in one printing process with a high printing quality. Therefore, as compared with a case where, for example, the printing jobs are performed separately, the total time and work required for the printing are decreased, which is more convenient for the user.

In the preferred embodiments according to the present invention, the printer 10 includes a plurality of ink heads ejecting the ink, and the plurality of ink heads are provided in an in-line array.

In the preferred embodiments according to the present invention, the printer 10 is a KIOSK printer. For the KIOSK printer, it is assumed that a user not accustomed to use the printer 10 makes a printing setting. Therefore, from the point of view of providing a high quality printed item with less variation in the printing quality, it is preferred to use the printing pattern creation device 50 or 50A disclosed herein together with the printer 10.

The printing pattern creation devices 50 and 50A, and a printing system 100 including the same in the preferred embodiments according to the present invention are described above. The printing pattern creation device and the printing system including the same are not limited to the above.

In the preferred embodiments shown in FIG. 6 and FIG. 13, step A, step B, step C and step D are executed in this order. The order of execution is not limited to this. For example, step B and/or step C may be executed before step A. In the case where the ink cartridges 22 of the printer 10 do not contain the primer ink, the primer ink is not used for printing, needless to say. Therefore, step B may be omitted. In the case where the ink cartridges 22 of the printer 10 do not contain the coating ink, the coating ink is not used for printing, needless to say. Therefore, the information to be input to the input 52 does not need to include information (3) or (4) regarding the surface finish. Step C may be omitted.

There is no specific limitation on the structure of the printer 10. For example, the printer 10 described in the above-described preferred embodiments is a shuttle (serial) printer, in which the ink heads 23 are included in the carriage 19, and printing is performed while the carriage 19 is reciprocally moved in the left-right direction X (shuttle movement). The printer is not limited to this. The technology disclosed herein is also applicable to, for example, a line printer, which includes line heads having the same width as that of a storage medium and performs printing while the line heads are set in a fixed position. In the above-described preferred embodiments, the carriage 19 of the printer 10 is moved in the left-right direction X, whereas the table 25 is moved in the front-rear direction Y. The printer 10 is not limited to this. The movement of the carriage 19 and the table 25 are relative to each other, and either one of the carriage 19 and the table 25 may move in the left-right direction X or in the front-rear direction Y. Alternatively, for example, the carriage 19 may be unmovable, and the table 25 may be moved both in the left-right direction X and in the front-rear direction Y.

In the above-described preferred embodiments, the printer 10 includes the ultraviolet lamps 24. The ultraviolet lamps 24 are not indispensable and may be omitted. In this case, the ink cartridges 21 and 22 may each store ink other than the ultraviolet-curable ink. The printer 10 may include a cutting head that cuts the printing target 70.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principle of the present invention. These preferred embodiments are provided with the understanding that they are not intended to limit the present invention to the preferred embodiments described in the specification and/or shown in the drawings. The present invention is not limited to the preferred embodiments described herein. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or used during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A printing pattern creation device creating a printing pattern for a recording device including ink heads ejecting a plurality of types of ink, a support that supports a printing target including a front surface and a rear surface, and a mover that moves the support member in a scanning direction with respect to the ink heads; the printing pattern including one or at least two printing processes, each including a repetition of ejection of the ink from each of the ink heads and movement of the support member in the scanning direction with respect to the ink heads, arranged in the order of execution, the printing pattern creation device comprising:

an input to which information regarding at least two types of the plurality of types of ink to be used to perform printing on the printing target among the plurality of types of ink, and information regarding the surface on which the printing is to be performed, are to be input;

a storage having stored thereon a plurality of predefined printing modes each using at least one type of the plurality of types of ink and each to be executed as one printing process;

a main creator that selects one or at least two printing modes among the plurality of printing modes based on the information supplied to the input to include all of the types of the plurality of types of ink inputted to the input, and arranges the selected printing modes in the order of execution, to create a printing pattern; and an output that outputs the created printing pattern to the recording device.

2. The printing pattern creation device according to claim 1, wherein the ink ejected from the ink heads includes process color ink and white ink;

the storage has stored thereon in advance at least a first printing mode as a printing process of ejecting the white ink and then ejecting the process color ink from the ink heads, and a second printing mode as a printing process of ejecting the process color ink and then ejecting the white ink from the ink heads; and the main creator includes a first setter structured such that:

in a case where the process color ink and the white ink are supplied to the input as the types of ink to be used, and the front surface is supplied to the input as the surface on which the printing is to be performed, the first setter selects the first printing mode among the plurality of printing modes stored on the storage; and in a case where the process color ink and the white ink are supplied to the input as the types of ink to be used, and the rear surface is supplied to the input as the surface on which the printing is to be performed, the first setter selects the second printing mode among the plurality of printing modes stored on the storage.

3. The printing pattern creation device according to claim 1, wherein the ink ejected from the ink heads includes primer ink;

the storage has stored thereon in advance at least a third printing mode as a printing process of ejecting the primer ink from the ink head; and the main creator further includes a second setter structured such that:

in a case where the primer ink is supplied to the input as the type of ink to be used, the second setter selects the third printing mode among the plurality of printing modes stored on the storage, and sets the third printing mode as the printing process to be performed first.

4. The printing pattern creation device according to claim 1, wherein the ink ejected from the ink heads includes coating ink;

information regarding whether or not a glossy surface finish is to be provided is supplied to the input;

the storage has stored thereon in advance at least a fourth printing mode as a printing process of ejecting only the coating ink from the ink head to provide a glossy surface finish; and the main creator further includes a third setter structured such that:

in a case where the coating ink is supplied to the input as the type of ink to be used, and information that a glossy surface finish is to be provided is supplied to the input, the third setter selects at least the fourth printing mode among the plurality of printing modes stored on the storage, and sets the fourth printing mode as the printing process to be performed at the end.

5. The printing pattern creation device according to claim 1, wherein the ink ejected from the ink heads includes process color ink, white ink and coating ink;

information regarding whether or not a matte surface finish is to be provided is supplied to the input;

the storage has stored thereon in advance at least a fifth printing mode as a printing process of ejecting only the coating ink from the ink head to provide a matte surface finish, a sixth printing mode as a printing process of ejecting the white ink and then ejecting the coating ink from the ink heads to provide a matte surface finish, and a seventh printing mode as a printing process of ejecting the process color ink and then ejecting the coating ink from the ink heads to provide a matte surface finish; and the main creator further includes a fourth setter structured such that:

in a case where the process color ink, the white ink and the coating ink are supplied to the input as the types of ink to be used, and information that a matte surface finish is to be provided is supplied to the input, the fourth setter selects at least the fifth printing mode among the plurality of printing modes stored on the storage, and sets the fifth printing mode as the printing process to be performed at the end;

in a case where the process color ink and the coating ink are supplied to the input as the types of ink to be used, and information that a matte surface finish is to be provided is supplied to the input, the fourth setter selects at least the sixth printing mode among the plurality of printing modes stored on the storage, and sets the sixth printing mode as the printing process to be performed at the end;

in a case where the white ink and the coating ink are supplied to the input as the types of ink to be used, and information that a matte surface finish is to be provided is supplied to the input, the fourth setter selects at least the seventh printing mode among the plurality of printing modes stored on the storage, and sets the seventh printing mode as the printing process to be performed at the end.

6. The printing pattern creation device according to claim 1, wherein:

the printing pattern creation device creates a printing pattern of performing a first printing job on a first printing target and a second printing job different from the first printing job on a second printing target at the same time in one printing process;

information regarding a type of ink to be used to perform the first printing job, information regarding the surface on which the first printing job is to be performed, information regarding a type of ink to be used to perform the second printing job, and information regarding the surface on which the second printing job is to be performed, are to be supplied to the input; and the main creator further includes a synthesizer structured such that, in a case where the surface on which the first printing job is to be performed is the same as the surface on which the second printing job is to be performed, the synthesizer determines a union of the type of ink to be used for the first printing job and the type of ink to be used for the second printing job to create a synthesized printing job including the first printing job and the second printing job in a synthesized manner.

7. A printing system, comprising:

a printing pattern creation device according to claim 1; and a recording device communicably connected with the printing pattern creation device.

8. The printing system according to claim 7, wherein the ink heads are provided in an in-line array in the recording device.

9. The printing system according to claim 7, wherein the recording device is a KIOSK printer.

10. A non-transitory computer-readable storage medium storing a computer program structured to cause a computer to operate as the printing pattern creation device according to claim 1.

11. The printing pattern creation device according to claim 1, wherein the plurality of types of ink includes two or more inks selected from a process color ink, a primer ink, a white ink, and a coating ink.

12. The printing pattern creation device according to claim 1, wherein the printing pattern creation device is separate from and located outside of the recording device.

13. The printing pattern creation device according to claim 1, wherein the recording device is a flatbed printer.

14. The printing pattern creation device according to claim 1, wherein:

the ink heads are mounted on a carriage engaged with a guide rail extending in a sub-scanning direction orthogonal to the scanning direction, and the carriage is movable in the sub-scanning direction.

* * * * *